US008109416B2

(12) United States Patent
Morand

(10) Patent No.: US 8,109,416 B2
(45) Date of Patent: Feb. 7, 2012

(54) VARIABLE FLOW VALVE OF A FILLING MACHINE

(75) Inventor: Alexandre Morand, Octeville sur Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 652 days.

(21) Appl. No.: 12/278,467

(22) PCT Filed: Feb. 19, 2007

(86) PCT No.: PCT/EP2007/051547

§ 371 (c)(1),
(2), (4) Date: Aug. 6, 2008

(87) PCT Pub. No.: WO2007/096321

PCT Pub. Date: Aug. 30, 2007

(65) Prior Publication Data

US 2009/0166386 A1 Jul. 2, 2009

(30) Foreign Application Priority Data

Feb. 23, 2006 (FR) ..... 06 50621

(51) Int. Cl.
*B65D 47/00* (2006.01)

(52) U.S. Cl. ..... 222/559; 222/548

(58) Field of Classification Search ..... 222/559, 222/548, 504–509, 108, 549–552, 425, 510–521; 251/218, 324

See application file for complete search history.

(56) References Cited

U.S. PATENT DOCUMENTS

| | | | | |
|---|---|---|---|---|
| 3,589,397 | A * | 6/1971 | Wagner | 137/614.2 |
| 4,573,611 | A * | 3/1986 | O'Connor | 222/147 |
| 4,802,508 | A * | 2/1989 | Styles et al. | 137/624.13 |
| 5,067,520 | A * | 11/1991 | Kremer et al. | 137/614.2 |
| 5,137,187 | A * | 8/1992 | Nichols et al. | 222/504 |
| 6,595,486 | B2 * | 7/2003 | Chen | 251/82 |
| 6,957,799 | B2 * | 10/2005 | Heilmann et al. | 251/82 |
| 2003/0155384 | A1 * | 8/2003 | Nagahata et al. | 222/504 |

FOREIGN PATENT DOCUMENTS

| | | |
|---|---|---|
| DE | 32 31 298 | 3/1983 |
| DE | 199 43 447 | 3/2000 |
| EP | 1 433 738 | 6/2004 |
| FR | 2 736 339 | 1/1997 |
| FR | 2 861 716 | 5/2005 |
| WO | WO 01/40098 | 6/2001 |
| WO | WO 2005/042396 | 5/2005 |

OTHER PUBLICATIONS

Jul. 26, 2007 International Search Report in corresponding PCT/EP2007/051547.

* cited by examiner

*Primary Examiner* — Lien Ngo
(74) *Attorney, Agent, or Firm* — Young & Thompson

(57) ABSTRACT

A filling device (10) includes a tubular body (12) including, in an upper section (14), a feeding chamber (18), and provided with a nozzle (20) for the flow of the liquid, wherein a liquid feeding conduit (22) leads into the feeding chamber (18) through a feeding orifice (24), and including a plug (26) which is controlled in axial sliding inside the tubular body (12), between an open position and a closed position. The device includes a servo valve (42, 142) coaxial to the plug (26) which is arranged in the upper section (14) of the tubular body (12). The servo valve (42, 142) includes a wall (44, 144) which partly closes the feeding orifice (24), and the servo valve (42, 142) is pivotingly controlled about its axis (A1) so as to regulate the feeding flow rate by modifying the closure area of the wall (44, 144).

12 Claims, 2 Drawing Sheets

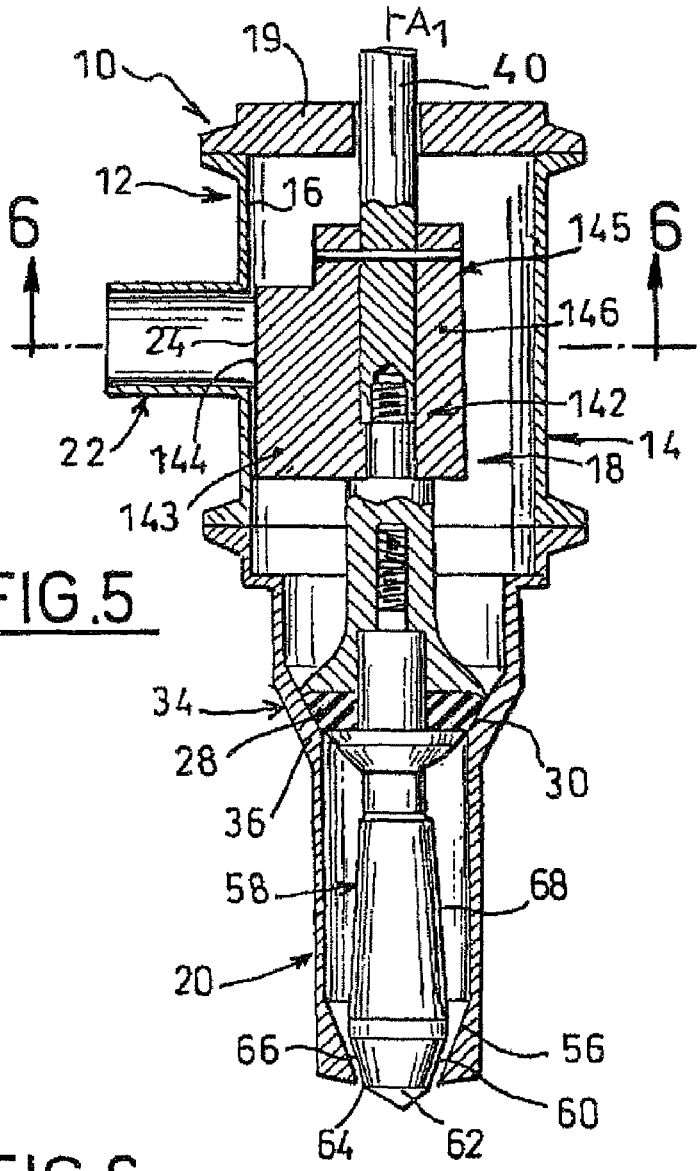
FIG.5
FIG.6
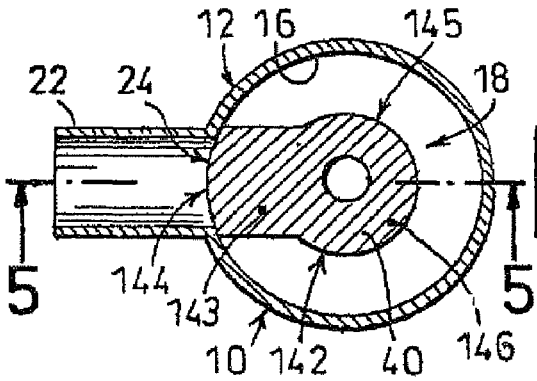
FIG.7
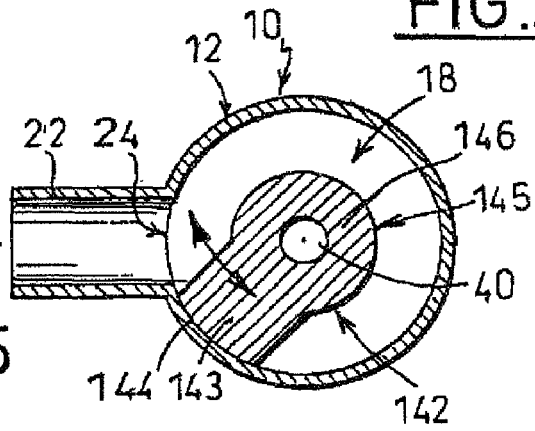

VARIABLE FLOW VALVE OF A FILLING MACHINE

BACKGROUND OF THE INVENTION

1. Field of the Invention

The invention relates to a device for filling receptacles with a liquid.

The invention relates more particularly to a device for filling receptacles with a liquid, comprising a generally tubular body that comprises, in an upper section, a liquid feed chamber which is provided, at its bottom axial end, with a nozzle for the flow of the liquid from the feed chamber to a receptacle, of the type in which a liquid feed duct leads into the feed chamber through a feed orifice, and of the type comprising a stopper that is controlled in sliding axially inside the tubular body between an axial open position and an axial closed position, and which comprises an annular bearing surface which rests axially against a matching seat arranged between the feed chamber and the nozzle, in the closed position.

This type of device is used mainly in automatic installations for filling polyethylene terephthalate (PET) bottles.

2. Description of the Related Art

When a receptacle is filled with a liquid, the user is usually faced with the problem of the formation of a froth on the surface of the liquid. Most of the liquids have a lesser or greater propensity to froth when they are inserted into a receptacle. For a given liquid, the size of the frothing phenomenon depends on the filling rate and the shape of the receptacle. For one and the same receptacle, the higher the rate, the greater the formation of froth.

When the foam clears, the receptacle contains less liquid than it should, hence a metering inaccuracy.

In addition, the volume left free in the receptacle, after the froth has cleared, contains air, therefore oxygen, which may adversely affect the correct conservation of the liquid: the smaller the free volume, the better conservation is.

The formation of froth is therefore a constraint which leads to reducing the filling rate, which is a disadvantage in terms of filling speed, or which leads to causing an overflow of the liquid, which is not a satisfactory solution.

To solve these problems, document WO-A-00/27743 proposes a filling device capable of operating with two discrete filling rates. The filling device comprises a stopper comprising two distinct open positions corresponding to two filling rates, which makes it possible to reduce the value of the flow at the end of the filling operation in order to reduce the formation of froth.

Although this filling device has given satisfaction, it does not make it possible to minimize the free volume in the receptacle in all configurations, for example for receptacles of different shapes.

SUMMARY OF THE INVENTION

The invention proposes to solve these problems by means of a filling device comprising means for varying the filling rate in a continuous manner.

Accordingly, the invention proposes a filling device of the type described above, characterized in that it comprises a cylindrical valve coaxial with the stopper that is arranged in the top section of the tubular body, in that the cylindrical valve comprises a peripheral stopping wall that is capable of partially closing off the feed orifice, when the stopper occupies its open position, the area of closure of the peripheral wall being a function of the angular position of the cylindrical valve, and in that the cylindrical valve is controlled so as to pivot about its axis so as to regulate the value of the feed flow by modifying the area of closure of the peripheral wall.

According to other features of the invention:

- the cylindrical valve comprises a tubular section coaxial with the stopper and with an external diameter substantially equal to the internal diameter of the top section of the tubular body, that is closed toward the top and that is open toward the bottom, the feed orifice opens radially into the top section of the tubular body, the peripheral wall of closure consists of the outer axial wall of the tubular section, and the tubular section comprises a radial opening that is positioned generally facing the feed orifice when the stopper occupies its open position, so as to have the feed duct communicate with the feed chamber through the central duct of the tubular section;
- the cylindrical valve comprises a tubular section coaxial with the stopper comprising a closure finger with an external diameter that is substantially equal to the internal diameter of the top section of the tubular body, in that the peripheral wall of closure consists of the outer axial wall of the finger, and in that the feed duct is closed when, the stopper occupying its closed position, the finger of the tubular section is positioned angularly generally facing the feed orifice in order to interrupt the communication with the feed chamber;
- the cylindrical valve is connected in axial movement with the stopper;
- the cylindrical valve is connected in pivoting with the stopper so that the angular pivoting of the cylindrical valve is controlled by the angular pivoting of the stopper;
- the cylindrical valve comprises a plunger core which extends axially downward, from the bearing surface, into the nozzle;
- the bottom end section of the nozzle comprises a concave frustoconical wall whose internal diameter decreases downward, the plunger core comprises, at its bottom axial end, a convex frustoconical surface substantially parallel to the concave frustoconical wall, the bottom axial end of the convex frustoconical surface is substantially radially aligned with the bottom axial end of the concave frustoconical wall when the stopper occupies its closed position, and the diameter of the bottom axial end of the convex frustoconical surface is less than the diameter of the bottom axial end of the concave frustoconical wall so as to arrange an annular space with a radial dimension that is just sufficient to cause a rising of the liquid by capillary action, at the time when the stopper closes;
- the bearing surface is arranged on a ring made of elastomer that is fitted to the body of the stopper.

BRIEF DESCRIPTION OF THE DRAWING FIGURES

Other features and advantages of the invention will appear on reading the following detailed description for the understanding of which reference will be made to the appended drawings in which:

FIG. 5 is a view in axial section similar to FIG. 1 that illustrates a variant embodiment of the cylindrical valve and that represents the filling device according to the invention when its stopper occupies a closed axial position and when its cylindrical valve occupies a fully closed angular position;

FIG. 6 is a view in cross section along the plane 6-6 that represents the filling device in the configuration of FIG. 5;

FIG. 7 is a view in cross section similar to FIG. 6 which represents the filling device of FIG. 5 when its cylindrical valve occupies a fully open angular position.

DETAILED DESCRIPTION OF THE INVENTION

Figures 1, 2, 3, 4:
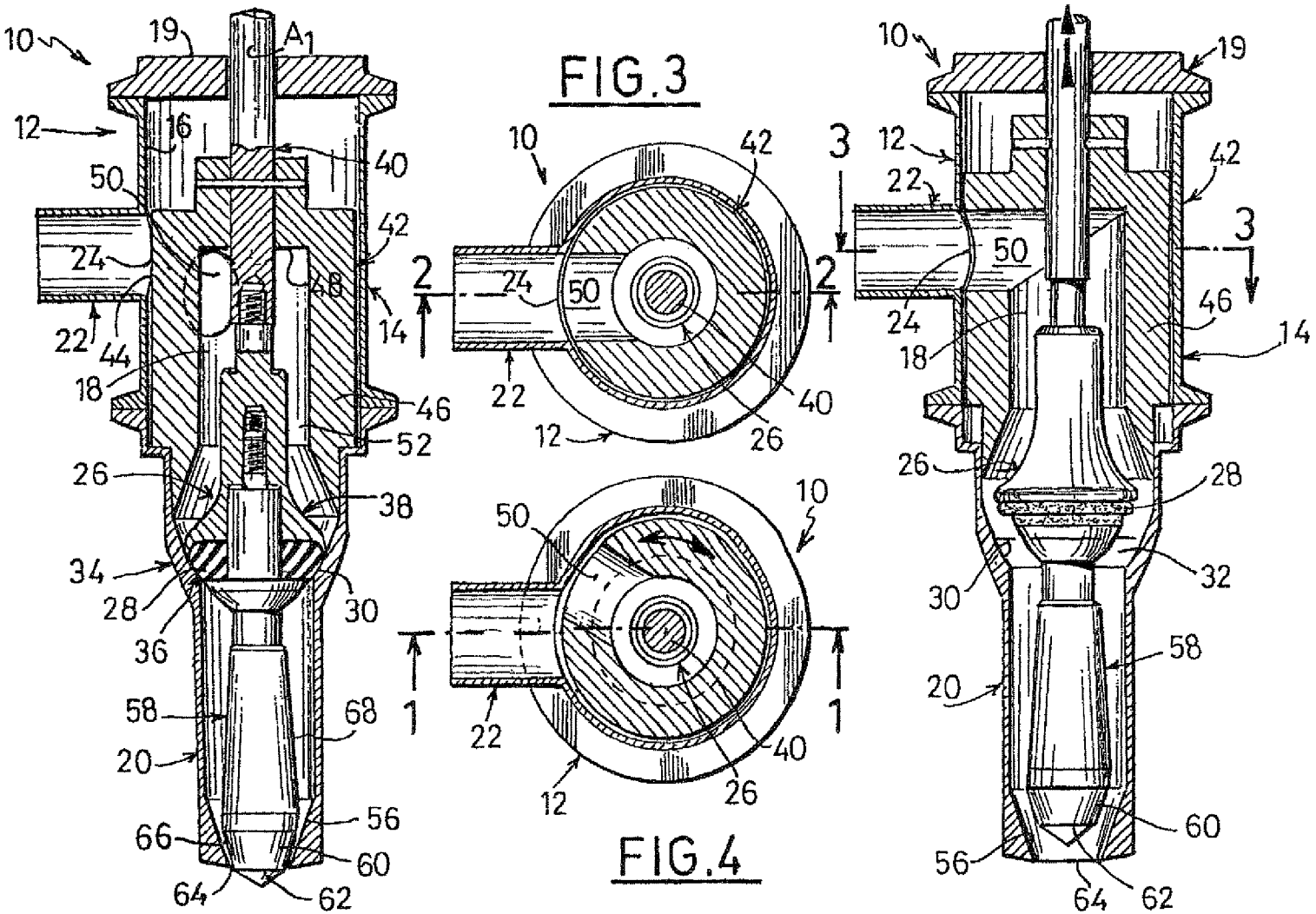
FIG. 1 is a view in axial section along the plane 1-1 that represents the filling device according to the invention when its stopper occupies a closed axial position and when its cylindrical valve occupies an angular position of partial closure.
FIG. 2 is a view similar to that of FIG. 1 along the sectional plane 2-2 which represents the filling device of FIG. 1 when the stopper occupies an open axial position and when the cylindrical valve occupies an angular position in which its opening is aligned with a liquid feed pipe.
FIG. 3 is a view in cross section along the plane 3-3 which represents the filling device of FIG. 1 in the configuration of FIG. 2.
FIG. 4 is a view similar to that of FIG. 3 that represents the filling device of FIG. 1 when the cylindrical valve occupies a partially closed angular position.

In the rest of the description, similar or identical elements will be indicated by the same reference numbers.

FIGS. 1 to 4 show a device 10 for filling receptacles with a liquid that is made according to the teachings of the invention.

The filling device 10 comprises a generally tubular body 12 which in this instance extends along a vertical axis A1 and which comprises, in a top section 14, a generally cylindrical bore 16.

In the rest of the description, in a nonlimiting manner, a vertical axial orientation along the axis A1 of the tubular body 12 will be used.

The bore 16 is closed, at its top axial end, by a transverse cap 19 that is attached to the tubular body 12.

The tubular body 12 comprises, at its bottom axial end, a generally tubular section forming a nozzle 20 for the flow of the liquid, from a feed chamber 18 to a receptacle (not shown) provided to be arranged beneath the filling device 10.

A liquid feed duct 22 leads into the feed chamber 18, in this instance through a radial feed orifice 24 that is pierced in the outer axial wall of the top section 14 of the tubular body 12.

The filling device 10 comprises a stopper 26, or valve element, which is controlled in axial sliding inside the tubular body 12.

The stopper 26 in this instance has generally a shape of revolution about its axis A1.

The stopper 26 slides between two extreme axial positions: a top open position, which is represented in FIG. 2, and a bottom closed position, which is represented in FIG. 1.

The stopper 26 comprises an annular bearing surface 28 that is provided to press axially against a matching seat 30, when the stopper 26 occupies its closed position, so as to hermetically close the annular passageway 32 allowing the liquid to travel toward the nozzle 20.

The seat 30 is arranged in an intermediate section 34 of the tubular body 12 that is situated between the feed chamber 18 and the nozzle 20.

The seat 30 has a generally concave frustoconical shape, with an internal diameter that decreases downward.

The bearing surface 28 is in this instance made in a ring 36 made of elastomer which is fitted to the body 38 of the stopper 26. The ring 36 forms an outer flange which presses against the seat 30, by elastic deformation, in the closed position, which seals the closure.

The body 38 of the stopper 26 is in this instance attached to the bottom axial end of a control rod 40 which extends axially upward, through the cap 19.

The rod 40 is connected to control means (not shown), for example a pneumatic cylinder which is capable of causing the rod 40 to slide upward and downward.

According to the teachings of the invention, the filling device 10 comprises a cylindrical valve 42, coaxial with the stopper 26, which is arranged in the feed chamber 18.

The cylindrical valve 42 comprises a peripheral wall (44) of closure which is capable of partially closing the feed orifice 24, when the stopper 26 occupies its open position. The area of closure of the wall 44 is a function of the angular position of the cylindrical valve 42.

The cylindrical valve 42 is controlled in pivoting about it axis A1 so as to regulate the value of the feed rate by modifying the area of closure of the peripheral wall 44.

According to the embodiment represented in FIGS. 1 to 4, the cylindrical valve 42 comprises a tubular section 46 coaxial with the stopper 26 and with an external diameter that is substantially equal to the internal diameter of the feed chamber 18.

The tubular section 46 of the cylindrical valve 42 is closed, at its top axial end, by a transverse wall 48 and it is open toward the bottom, that is to say toward the nozzle 20.

The tubular section 46 of the cylindrical valve 42 comprises a radial opening 50 which is positioned generally facing the feed orifice 24, when the stopper 26 occupies its open position, so as to have the feed duct 22 communicate with the feed chamber 18 through the central duct 52 of the tubular section 46.

Advantageously, the radial opening 50 has a circular section of passage and its diameter is substantially equal to the diameter of the feed orifice 24.

The peripheral wall 44 of closure consists of the outer axial wall of the tubular section 46 around the opening 50.

Advantageously, the cylindrical valve 42 is attached to the control rod 40, so that it is connected to the stopper 26, both in axial movement and in pivoting.

Therefore, the stopper 26 and the cylindrical valve 42 may be controlled simultaneously in the appropriate axial and angular position.

Note that the cylindrical valve 42 slides axially in the bore 16 with the stopper 26.

According to an advantageous embodiment, the top section of the nozzle 20 comprises a concave cylindrical wall 54 and the bottom end section of the nozzle 20 comprises a concave frustoconical wall 56 whose internal diameter decreases downward.

The stopper 26 comprises a plunger core 58 which extends axially downward, from the bearing surface 28 inside the nozzle 20.

The plunger core 58 comprises, at its bottom axial end, a convex frustoconical surface 60 substantially parallel to the concave frustoconical wall 56 of the nozzle 20.

The axial length of the convex frustoconical surface 60 is less than the axial length of the concave frustoconical wall 56.

The bottom axial end 62 of the convex frustoconical surface 60 is substantially radially aligned with the bottom axial end 64 of the concave frustoconical wall 56, when the stopper 26 occupies its closed position.

The diameter of the bottom axial end 62 of the convex frustoconical surface 60 is less than the diameter of the bottom axial end 64 of the concave frustoconical wall 56, which arranges an annular space 66 with a radial dimension that is just sufficient to cause a rising of the liquid by capillary action, at the time when the stopper 26 closes.

Advantageously, the plunger core 58 comprises a convex frustoconical intermediate section 68 with a diameter that increases downward.

Now the operation of the filling device 10 according to the invention is described.

Before filling, the stopper 26 occupies its closed position (FIG. 1).

When a bottle is placed axially beneath the nozzle 20, the stopper 26 is controlled to the open position (FIG. 2) by means of the rod 40, so that the liquid situated above the seat 30, in the feed chamber 18 and in the feed duct 22, descends into the nozzle 20.

The liquid flows along and around the core 58.

Note that the core 58 guides the flow of liquid so as to produce a flow of the laminar type, which minimizes the production of froth and accelerates the filling of the bottle.

Advantageously, at the beginning of filling, the cylindrical valve 42 is controlled into the fully open angular position, which is represented in FIGS. 2 and 3, that is to say that the opening 50 is aligned with the feed orifice 24.

Toward the end of filling, the cylindrical valve 42 is controlled to pivot about its axis A1, to a final angular position as represented in FIG. 4.

During the pivoting of the cylindrical valve 42, the area of the section of passage of the liquid between the feed duct 22 and the opening 50 reduces progressively, because the peripheral wall 44 of the cylindrical valve 42 increasingly closes off the feed orifice 24, so that the liquid filling rate diminishes progressively.

Note that the substantially continuous diminution of the filling rate makes it possible to minimize turbulence in the liquid flow, which minimizes the production of froth.

At the end of filling, the stopper 26 is controlled to the closed position, which stops the flow of the liquid to the nozzle 20 almost instantaneously.

Thanks to the structure of the bottom end section of the core 58 and to the structure of the bottom end section of the nozzle 20, filling stops completely since the liquid that reaches the bottom end of the nozzle 20 tends to rise by capillary action in the annular space 66.

In comparison with the embodiment represented in FIGS. 1 to 4, a variant embodiment of the cylindrical valve 142 that the filling device 10 according to the invention comprises is described below.

Advantageously, the cylindrical valve 142 is coaxial with the stopper 26 and it is arranged in the feed chamber 18.

Therefore, the cylindrical valve 142 comprises a peripheral wall 144 of closure which is capable of partially closing the feed orifice 24, when the stopper 26 occupies its open position. The area of closure of the wall 144 is a function of the angular position of the cylindrical valve 142.

The cylindrical valve 142 is controlled to pivot about its axis A1 in order to regulate the value of the feed rate by modifying the area of closure of the peripheral wall 144.

According to the variant embodiment represented in FIGS. 5 to 7, the cylindrical valve 142 comprises a tubular section 146 from which a closure finger 143 extends radially.

The tubular section 146 is coaxial with the stopper 26 and it is preferably centered on the axis A1 of the stopper 26.

The tubular section 146 comprises an outer cylindrical surface 145 determining its external diameter which is less than the internal diameter of the feed chamber 18 that is determined with the cylindrical bore 16 of the top section 14 of the body 12.

The top portion of the annular-shaped feed chamber 18 is delimited radially by the outer cylindrical surface 145 and the bore 16 and is open downward, that is to say toward the nozzle 20.

The peripheral wall 144 of closure consists of the outer axial face of the closing finger 143 extending vertically and whose external diameter is substantially equal to the internal diameter of the feed chamber 18.

As can be seen in FIGS. 5 and 6, the cylindrical valve 142 is in the fully closed angular position which corresponds to a position of the cylindrical valve 142 in which the closure finger 143 is angularly positioned generally facing the feed orifice 24 of the feed duct 22.

The feed orifice 24 is then closed by the peripheral wall 144 of the finger 143 whose width is at least equal to the diameter of the feed orifice 24.

When the stopper 26 occupies its open position, the angular movement of the tubular section 146 of the cylindrical valve 142 and of the finger 143 causes the feed orifice 24 to open fully or partially, so as to have the feed duct 22 communicate with the top portion of the feed chamber 18 surrounding the section 146.

Advantageously, the cylindrical valve 142 is attached to the control rod 40, so that it is connected to the stopper 26, both in axial movement and in pivoting and that it slides axially in the bore 16 with the stopper 26.

Therefore, the stopper 26 and the cylindrical valve 142 may be controlled simultaneously to the appropriate axial and angular position.

The operation of the filling device 10 with the cylindrical valve 142 is consequently similar to that described above.

Before filling, the stopper 26 occupies its closed position shown in FIG. 5.

When a bottle is placed axially beneath the nozzle 20, the stopper 26 is controlled to the open position (not shown, which is similar to that shown in FIG. 2) by means of the rod 40, so that the liquid situated above the seat 30, in the feed chamber 18 and in the feed duct 22, descends into the nozzle 20.

The liquid flows along and around the core 58 which guides the stream of liquid so as to produce a flow of the laminar type in order to minimize the production of froth and accelerate the filling of the bottle.

Advantageously, at the beginning of filling, the cylindrical valve 142 is controlled to the fully open angular position, which is represented in FIG. 7, that is to say the position in which the finger 143 is offset angularly so that, the closing wall 144 being opposite the bore 16, the feed orifice 24 communicates fully with the chamber 18.

Toward the end of filling, the cylindrical valve 142 is controlled to pivot about its axis A1 so as to return to the previous totally closed position which, represented in FIG. 6, is the final angular position.

While the cylindrical valve 142 pivots, the area of the section of passage of the liquid between the feed duct 22 and the chamber 18 reduces progressively, because the peripheral wall 144 of the finger 143 of the cylindrical valve 42 increasingly closes the feed orifice 24 so that the liquid filling rate reduces progressively.

At the end of filling, the stopper 26 is controlled to the closed position, which stops the flow of liquid toward the nozzle 20 almost instantaneously.

The invention claimed is:

1. A device (10) for filling receptacles with a liquid, comprising:

a generally tubular body (12);

a liquid feed chamber (18) in an upper section (14) of the generally tubular body (12), the liquid feed chamber (18) having a bottom axial end, with provided with a nozzle (20) adapted for feed flow of the liquid from the feed chamber (18) to a receptacle in which a liquid feed duct (22) leads into the feed chamber (18) through a feed orifice (24);

a stopper (26) that is controlled in sliding axially inside the tubular body (12) between an axial open position and an axial closed position, the stopper comprising an annular bearing surface (28) which rests axially against a matching seat (30) arranged between the feed chamber (18) and the nozzle (20), in the closed position; and a cylindrical valve (42, 142) coaxial with the stopper (26) that is arranged in the upper section (14) of the tubular body (12), the cylindrical valve (42, 142) comprising a peripheral stopping wall (44, 144) that is capable of partially closing off the feed orifice (24), when the stopper (26) occupies the open position, an area of closure of the peripheral wall (44, 144) being a function of the angular position of the cylindrical valve (42), and the cylindrical valve (42, 142) is controlled so as to pivot about an axis (A1) so as to regulate a value of the feed flow by modifying an area of closure of the peripheral wall (44, 144).

2. The device (10) as claimed in claim 1, wherein the cylindrical valve (42) comprises a tubular section (46) coaxial with the stopper (26) and with an external diameter substantially equal to an internal diameter of the upper section (14) of the tubular body (12), that is closed toward a top and that is open toward a bottom, in that the feed orifice (24) opens radially into the upper section (14) of the tubular body (12), in that the peripheral wall (44) of closure consists of the outer axial wall of the tubular section (46), and in that the tubular section (46) comprises a radial opening (50) that is positioned generally facing the feed orifice (24) when the stopper (26) occupies its open position, so as to have the feed duct (22) communicate with the feed chamber (18) through a central duct (52) of the tubular section (46).

3. The device (10) as claimed in claim 1, wherein the cylindrical valve (142) comprises a tubular section (146) coaxial with the stopper (26) comprising a closure finger (143) with an external diameter that is substantially equal to the internal diameter of the upper section (14) of the tubular body (12), in that the peripheral wall (144) of closure consists of the outer axial wall of the finger (143), and in that the feed duct (22) is closed when, the stopper (26) occupying its closed position, the finger (143) of the tubular section (146) is positioned angularly generally facing the feed orifice (24) in order to interrupt the communication with the feed chamber (18).

4. The device (10) as claimed in claim 1, wherein the cylindrical valve (42, 142) is connected in axial movement with the stopper (26).

5. The device (10) as claimed in claim 1, wherein the cylindrical valve (42) is connected in pivoting with the stopper (26) so that the angular pivoting of the cylindrical valve (42, 142) is controlled by the angular pivoting of the stopper (26).

6. The device (10) as claimed in claim 1, wherein the stopper (26) comprises a plunger core (58) which extends axially downward, from the bearing surface (28), into the nozzle (20).

7. The device (10) as claimed in claim 6, wherein the bottom end section of the nozzle (20) comprises a concave frustoconical wall (56) whose internal diameter decreases downward, in that the plunger core (58) comprises, at a bottom axial end of the plunger core, a convex frustoconical surface (60) substantially parallel to the concave frustoconical wall (56), a bottom axial end (62) of the convex frustoconical surface (60) is substantially radially aligned with a bottom axial end (64) of the concave frustoconical wall (56) when the stopper (26) occupies the closed position, and a diameter of the bottom axial end (62) of the convex frustoconical surface (60) is less than a diameter of the bottom axial end (64) of the concave frustoconical wall (56) so as to arrange an annular space (66) with a radial dimension that is just sufficient to cause a rising of the liquid by capillary action, at a time when the stopper (26) closes.

8. The device (10) as claimed in claim 1, wherein the bearing surface (28) is arranged on a ring (36) made of elastomer that is fitted to the body (38) of the stopper (26).

9. The device (10) as claimed in claim 2, wherein the cylindrical valve (42, 142) is connected in axial movement with the stopper (26).

10. The device (10) as claimed in claim 2, wherein the cylindrical valve (42) is connected in pivoting with the stopper (26) so that the angular pivoting of the cylindrical valve (42, 142) is controlled by the angular pivoting of the stopper (26).

11. The device (10) as claimed in claim 2, wherein the stopper (26) comprises a plunger core (58) which extends axially downward, from the bearing surface (28), into the nozzle (20).

12. The device (10) as claimed in claim 2, wherein the bearing surface (28) is arranged on a ring (36) made of elastomer that is fitted to the body (38) of the stopper (26).

* * * * *